US009382776B2

(12) United States Patent
Murphree et al.

(10) Patent No.: US 9,382,776 B2
(45) Date of Patent: Jul. 5, 2016

(54) WELLBORE ISOLATION DEVICE MADE FROM A POWDERED FUSIBLE ALLOY MATRIX

(71) Applicant: HALLIBURTON ENERGY SERVICES, INC., Houston, TX (US)

(72) Inventors: Zachary R. Murphree, Carrollton, TX (US); Michael L. Fripp, Carrollton, TX (US); Zachary W. Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 222 days.

(21) Appl. No.: 14/136,932

(22) Filed: Dec. 20, 2013

(65) Prior Publication Data

US 2014/0110123 A1 Apr. 24, 2014

Related U.S. Application Data

(63) Continuation-in-part of application No. 13/523,095, filed on Jun. 14, 2012.

(51) Int. Cl.

| | |
|---|---|
| ***E21B 34/00*** | (2006.01) |
| ***B22F 5/00*** | (2006.01) |
| ***E21B 29/00*** | (2006.01) |
| ***E21B 33/12*** | (2006.01) |

(52) U.S. Cl.

CPC . *E21B 34/00* (2013.01); *B22F 5/00* (2013.01); *E21B 29/00* (2013.01); *E21B 33/1204* (2013.01)

(58) Field of Classification Search

None

See application file for complete search history.

(56) References Cited

U.S. PATENT DOCUMENTS

| | | | | |
|---|---|---|---|---|
| 2,298,129 | A * | 10/1942 | Irons | C09K 8/5045 166/288 |
| 2,656,891 | A * | 10/1953 | Toelke | E21B 33/1204 166/122 |
| 3,208,530 | A * | 9/1965 | Allen | E21B 33/1204 166/123 |
| 3,273,641 | A * | 9/1966 | Bourne | E21B 33/134 166/205 |
| 3,578,084 | A * | 5/1971 | Bombardieri | E21B 33/14 166/241.6 |
| 4,939,038 | A | 7/1990 | Inabata | |
| 5,419,357 | A * | 5/1995 | Lhymn | F16K 17/383 137/72 |
| 5,561,829 | A | 10/1996 | Sawtell et al. | |
| 7,350,582 | B2 | 4/2008 | McKeachnie et al. | |
| 7,798,236 | B2 | 9/2010 | McKeachnie et al. | |
| 8,535,604 | B1 | 9/2013 | Baker et al. | |
| 2002/0056553 | A1 | 5/2002 | Duhon et al. | |
| 2006/0144591 | A1 * | 7/2006 | Gonzalez | E21B 29/10 166/277 |
| 2006/0175703 | A1 | 8/2006 | Godijn et al. | |
| 2013/0059074 | A1 | 3/2013 | Xu et al. | |
| 2013/0098203 | A1 | 4/2013 | Sherman et al. | |
| 2013/0327540 | A1 | 12/2013 | Hamid et al. | |

OTHER PUBLICATIONS

Degradable Casing Perforation Ball Sealers and Methods for Use in Well Treatment, IPCOM000215741D, Mar. 7, 2012. Available at: http://priorartdatabase.com/IPCOM/000215741.

Solu-Plugs—Delayed Frac Plugs, IPCOM000176055D, Nov. 3, 2008. Available at: http://www.ip.com/pubview/IPCOM000176055D.

* cited by examiner

*Primary Examiner* — George Wyszomierski
*Assistant Examiner* — Ngoclan T Mai
(74) *Attorney, Agent, or Firm* — McGuire Woods LLP

(57) ABSTRACT

A method of producing at least a portion of a wellbore isolation device comprising: providing a fusible alloy matrix in a powdered form; placing at least the particles of the fusible alloy matrix powder into a mold; compacting the particles located inside the mold via an application of pressure; and fusing the particles together to form a solid material, wherein the solid material forms the at least a portion of the wellbore isolation device.

25 Claims, 1 Drawing Sheet

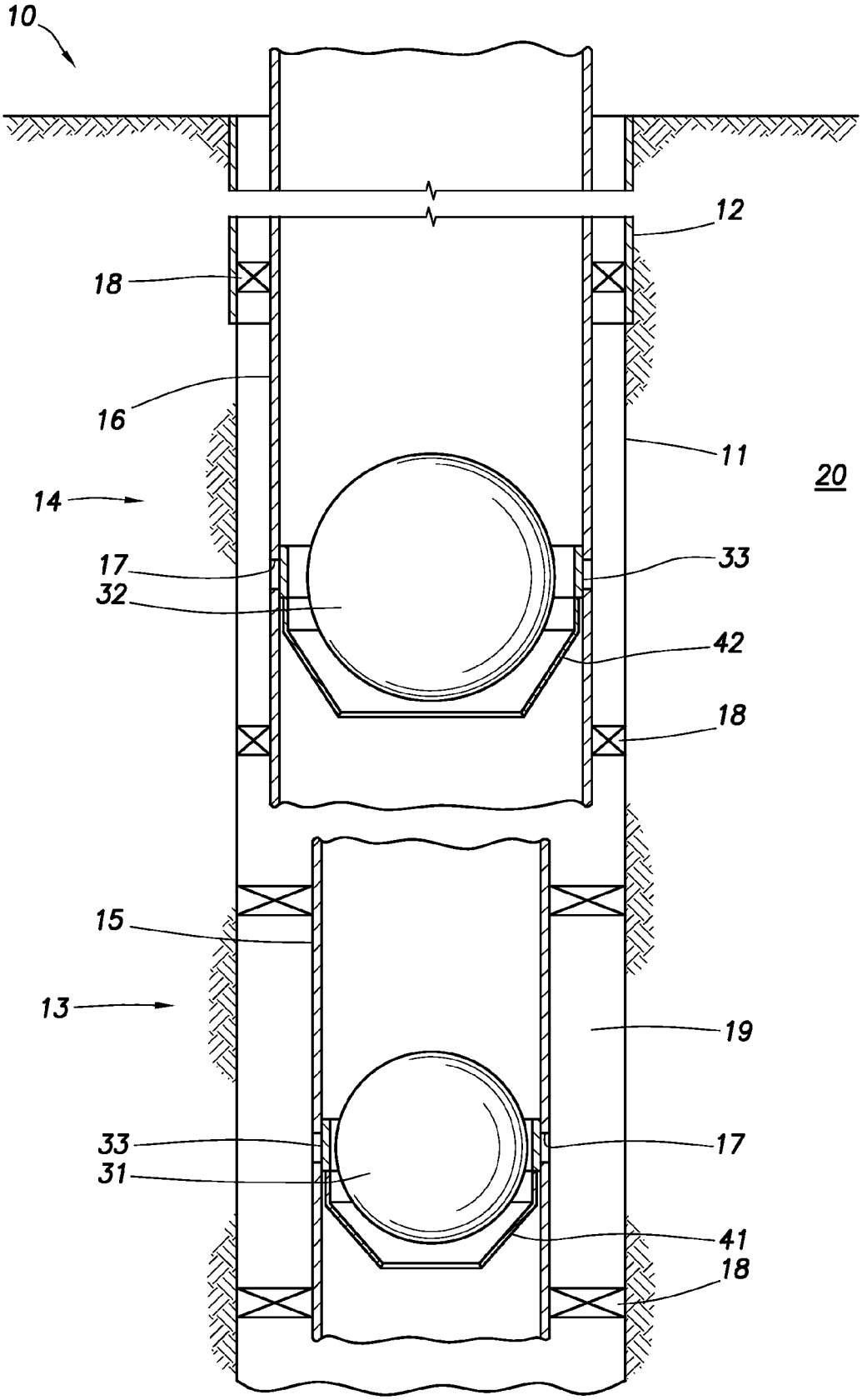
10
12
18
16
11
20
14
17
33
32
42
18
15
13
19
33
17
31
41
18

WELLBORE ISOLATION DEVICE MADE FROM A POWDERED FUSIBLE ALLOY MATRIX

TECHNICAL FIELD

Powder metallurgy can be used to manufacture an isolation device. The isolation device can be used in an oil or gas operation to help restrict the flow of a fluid past the isolation device.

BRIEF DESCRIPTION OF THE FIGURES

The features and advantages of certain embodiments will be more readily appreciated when considered in conjunction with the accompanying figures. The figures are not to be construed as limiting any of the preferred embodiments.

FIG. 1 depicts a well system containing more than one isolation device.

DETAILED DESCRIPTION

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more compositions, substances, particles, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (21.7° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device. An isolation device can be used for zonal isolation and functions to block fluid flow within a tubular, such as a tubing string, or within an annulus. The blockage of fluid flow prevents the fluid from flowing into the zones located downstream of the isolation device and isolates the zone of interest. As used herein, the relative term "downstream" means at a location further away from a wellhead. In this manner, treatment techniques can be performed within the zone of interest.

Common isolation devices include, but are not limited to, a ball, a plug, a bridge plug, a wiper plug, and a packer. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished, for example, via a ball and seat by dropping the ball from the wellhead onto the seat that is located within the wellbore. The ball engages with the seat, and the seal created by this engagement prevents fluid communication into other zones downstream of the ball and seat. In order to treat more than one zone using a ball and seat, the wellbore can contain more than one ball seat. For example, a seat can be located within each zone. Generally, the inner diameter (I.D.) of the tubing string where the ball seats are located is different for each zone. For example, the I.D. of the tubing string sequentially decreases at each zone, moving from the wellhead to the bottom of the well. In this manner, a smaller ball is first dropped into a first zone that is the farthest downstream; that zone is treated; a slightly larger ball is then dropped into another zone that is located upstream of the first zone; that zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream zones. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

The bottomhole temperature of a well varies significantly, depending on the subterranean formation, and can range from about 100° F. to about 600° F. (about 37.8° C. to about 315.6° C.). As used herein, the term "bottomhole" means at the location of the isolation device. It is often desirable to have a substance undergo a phase transition at the bottomhole temperature of a well. As used herein, a "phase transition" means any change that occurs to the physical properties of the substance. As used herein, a "phase transition" can include, without limitation, a change in the phase of the substance (i.e., from a solid to a liquid or semi-liquid, from a liquid or semi-liquid to a gas, etc.), a glass transition, a change in the amount of crystallinity of the substance, physical changes to the amorphous and/or crystalline portions of the substance, and any combinations thereof. A substance will undergo a phase transition at a "phase transition temperature." As used herein, a "phase transition temperature" includes a single temperature and a range of temperatures at which the substance undergoes a phase transition. Therefore, it is not necessary to continually specify that the phase transition temperature can be a single temperature or a range of temperatures throughout. By way of example, a substance will have a glass transition temperature or range of temperatures, symbolized as $T_g$. The $T_g$ of a substance is generally lower than its melting temperature $T_m$. The glass transition can occur in the amorphous regions of the substance.

However, the options of elements available for use in these circumstances are severely limited because there are only so many elements to choose from and each element, for example, has a single, unique melting point at a given pressure. A different material may have to be used that has a melting point equal to or less than the bottomhole temperature of the well. A composition of two or more substances will have a phase transition that is different from the phase transitions of the individual substances making up the mixture. The use of various compositions increases the number of phase transition temperatures that are available for use. In this manner, one can determine the bottomhole temperature and pressure of a well and then select the appropriate composition for use at that temperature and pressure.

A eutectic composition is a mixture of two or more substances that undergoes a phase transformation at a lower temperature than all of its pure constituent components. Stated another way, the temperature at which a eutectic composition undergoes the phase transformation is a lower temperature than any composition made up of the same substances can freeze or melt at and is referred to as the transformation temperature. A solid-liquid phase transformation temperature can also be referred to as the freezing point or melting point of a substance or composition. The substances making up the eutectic composition can be compounds, such as metal alloys or thermoplastics, or metallic elements. By way of example, the melting point of bismuth at atmospheric pressure (101 kilopascals) is 520° F. (271.1° C.) and the melting point of lead is 621° F. (327.2° C.); however, the melting point of a composition containing 55.5% bismuth and 44.5% lead has a melting point of 244° F. (117.8° C.). As can be seen the bismuth-lead composition has a much lower melting point than both, elemental bismuth and elemental lead. Not all compositions have a melting point that is lower than all of the individual substances making up the composition. By way of example, a composition of silver and gold has a higher melting point compared to pure silver, but is lower than that of pure gold. Therefore, a silver-gold composition cannot be classified as a eutectic composition.

A eutectic composition can also be differentiated from other compositions because it solidifies (or melts) at a single, sharp temperature. It is to be understood that the phrases "phase transformation" and "solid-liquid phase transformation," the term "melt" and all grammatical variations thereof, and the term "freeze" and all grammatical variations thereof are meant to be synonymous. Non-eutectic compositions generally have a range of temperatures at which the composition melts. There are other compositions that can have both: a range of temperatures at which the composition melts; and a melting point less than at least one of the individual substances making up the composition. These other substances can be called hypo- and hyper-eutectic compositions. A hypo-eutectic composition contains the minor substance (i.e., the substance that is in the lesser concentration) in a smaller amount than in the eutectic composition of the same substances. A hyper-eutectic composition contains the minor substance in a larger amount than in the eutectic composition of the same substances. Generally, with few exceptions, a hypo- and hyper-eutectic composition will have a solid-liquid phase transition temperature higher than the eutectic transition temperature but less than the melting point of at least one of the individual substances making up the composition.

The following table illustrates a eutectic, hypo- and hyper-eutectic composition, the concentration of each substance making up the composition (expressed as a % by weight of the composition), and their corresponding transformation temperature and melting temperature ranges. As can be seen, the hyper-eutectic composition contains cadmium (the minor substance) in a larger amount than the eutectic composition, and the hypo-eutectic composition contains cadmium in a smaller amount than in the eutectic composition. As can also be seen, both the hyper- and hypo-eutectic compositions have a range of melting points; whereas, the eutectic composition has a single melting temperature. Moreover, all 3 compositions have a eutectic temperature or melting point range that is lower than each of the 4 individual elements—Bi equals 520° F. (271.1° C.), Pb equals 621° F. (327.2° C.), Sn equals 450° F. (232.2° C.), and Cd equals 610° F. (321.1° C.).

| Type of Composition | Conc. of Bismuth (Bi) | Conc. of Lead (Pb) | Conc. of Tin (Sn) | Conc. of Cadmium (Cd) | Melting Temperature (° F.) |
|---|---|---|---|---|---|
| Eutectic | 50 | 26.7 | 13.3 | 10 | 158 |
| Hyper-eutectic | 50 | 25 | 12.5 | 12.5 | 158-165 |
| Hypo-eutectic | 50.5 | 27.8 | 12.4 | 9.3 | 158-163 |

A fusible alloy can be a eutectic composition. As used herein, the term "fusible alloy" means an alloy wherein at least one phase of the alloy has a melting point below 482° F. (250° C.). As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

It can be difficult to make an isolation device containing a fusible alloy matrix and optional particles due to differences in the density of the materials. These differences in density can result in stratification and inhomogeneity of the matrix and finished product. It has been discovered that an isolation device can be made from a fusible alloy matrix via a powder metallurgy process. The process of manufacturing the isolation device allows the isolation device to have little to no stratification or other inhomogeneities, a desired density via the inclusion of optional density-reducing particles, and a desired strength via the inclusion of optional strength-enhancing particles. The fusible alloy matrix will then undergo a phase transformation in the wellbore after a desired amount of time. The fusible alloy can be removed from the wellbore after its intended use. As such, the ingredients for the fusible alloy matrix and respective concentrations can be selected, as mentioned above, so the matrix will undergo a phase transition at the bottomhole temperature of the wellbore.

According to an embodiment, a method of producing at least a portion of a wellbore isolation device comprises: providing a fusible alloy matrix in a powdered form; placing at least the particles of the fusible alloy matrix powder into a mold; compacting the particles located inside the mold via an application of pressure; and fusing the particles together to form a solid material, wherein the solid material forms the at least a portion of the wellbore isolation device.

According to another embodiment, a method of producing at least a portion of a wellbore isolation device comprises: producing a fusible alloy matrix in a powdered form; blending the particles of the fusible alloy matrix and at least one other type of particle together; placing the particles into a mold; compacting the particles located inside the mold via an application of pressure; and fusing the particles together to form a solid material, wherein the solid material forms the at least a portion of the wellbore isolation device.

Turning to the Figures, FIG. 1 depicts an example of a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A first section of tubing string 15 can be installed in the wellbore 11. A second section of tubing string 16 (as well as multiple other sections of tubing string, not shown) can be installed in the wellbore 11. The well system 10 can comprise at least a first zone 13 and a second zone 14. The well system 10 can also include more than two zones, for example, the well system 10 can further include a third zone, a fourth zone, and so on. The well system 10 can further include one or more packers 18. The packers 18 can be used in addition to the isolation device to isolate each zone of the wellbore 11. The isolation device can be the packers 18. The packers 18 can be used to help prevent fluid flow between one or more zones (e.g., between the first zone 13 and the second zone 14) via an annulus 19. The tubing string 15/16 can also include one or more ports 17. One or more ports 17 can be located in each section of the tubing string. Moreover, not every section of the tubing string needs to include one or more ports 17. For example, the first section of tubing string 15 can include one or more ports 17, while the second section of tubing string 16 does not contain a port. In this manner, fluid flow into the annulus 19 for a particular section can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

As can be seen in FIG. 1, the first section of tubing string 15 can be located within the first zone 13 and the second section of tubing string 16 can be located within the second zone 14. The wellbore isolation device can be a ball, a plug, a bridge plug, a wiper plug, or a packer. The wellbore isolation device can restrict fluid flow past the device. The wellbore isolation device may be free falling device or it may be tethered to the surface. As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string. When the first section of tubing string 15 is located downstream of the second section of tubing string 16, then the inner diameter (I.D.) of the first section of tubing string 15 can be less than the I.D. of the second section of tubing string 16. In this manner, a first ball 31 can be placed into the first section of tubing string 15. The first ball 31 can have a smaller diameter than a second ball 32. The first ball 31 can engage a first seat 41. Fluid can now be temporarily restricted or prevented from flowing into any zones located downstream of the first zone 13. In the event it is desirable to temporarily restrict or prevent fluid flow into any zones located downstream of the second zone 14, the second ball 32 can be placed into second section of tubing string 16 and will be prevented from falling into the first section of tubing string 15 via the second seat 42 or because the second ball 32 has a larger outer diameter (O.D.) than the I.D. of the first section of tubing string 15. The second ball 32 can engage the second seat 42. The ball (whether it be a first ball 31 or a second ball 32) can engage a sliding sleeve 33 during placement. This engagement with the sliding sleeve 33 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular zone. As such, a fluid can be produced from the subterranean formation 20 or injected into the formation.

According to an embodiment, the isolation device is at least partially capable of restricting or preventing fluid flow between a first zone 13 and a second zone 14. By way of example, the isolation device can be used to restrict or prevent fluid flow between different zones within the tubing string while packers 18 and/or cement can be used to restrict or prevent fluid flow between different zones within the annulus 19. The isolation device can also be the only device used to prevent or restrict fluid flow between zones. By way of another example, there can also be two or more isolation devices positioned within a given zone. According to this example, one isolation device can be a packer while the other isolation device can be a ball and seat or a bridge plug. The first zone 13 can be located upstream or downstream of the second zone 14. In this manner, depending on the oil or gas operation, fluid is restricted or prevented from flowing downstream or upstream into the second zone 14. Examples of isolation devices capable of restricting or preventing fluid flow between zones include, but are not limited to, a ball, a plug, a bridge plug, a wiper plug, and a packer.

The methods include providing the fusible alloy matrix in a powdered form. A powder is particles of a particular substance. The particle size of the fusible alloy matrix powder can be in the range of about 10 nanometers "nm" to about 10 millimeters "mm". The methods can further include obtaining the fusible alloy matrix in a powdered form, for example, from a supplier. The methods can also further include producing the powdered form of the fusible alloy matrix. The step of producing the powdered form of the matrix can include, without limitation: sponge iron processing; atomization—including liquid or water atomization, gas atomization, and centrifugal atomization; centrifugal disintegration; comminution; grinding; chemical reactions; or electrolytic deposition.

The metal of the fusible metal alloy can be selected from the group consisting of, lithium, sodium, potassium, rubidium, cesium, francium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold, graphite, and combinations thereof. Preferably, the metal of the fusible metal alloy is selected from the group consisting of lead, tin, bismuth, indium, cadmium, silver, gallium, zinc, antimony, copper, and combinations thereof. According to an embodiment, the fusible metal alloy does not comprise a toxic heavy metal. The fusible alloy can also contain a non-metal. According to an embodiment, the fusible alloy is a eutectic, hypo-eutectic, or hyper-eutectic composition. According to another embodiment, the fusible alloy matrix undergoes a phase transformation at or near the bottomhole temperature of the wellbore after a desired amount of time. According to another embodiment, the fusible alloy matrix undergoes a phase transformation at a temperature that is 36° F. (2.2° C.) or more lower than the bottomhole temperature of the wellbore. According to another embodiment, the fusible alloy matrix undergoes a phase transition at a temperature that is at least 36° F. (2.2° C.) higher than the surface temperature.

The methods also include placing at least the particles of the fusible alloy matrix powder into a mold. The mold can have a desired size and shape to form the at least a portion of the wellbore isolation device. The mold can also be cylindrical in shape or another shape and the at least the portion of the wellbore isolation device or the entire isolation device can be machined from the cylindrical shape after the step of fusing. The mold can be a press. The mold can also be the entire wellbore isolation device. For example, if the isolation device is a ball, then the mold can be used to form the entire ball. The ball isolation device can have different cross-sectional sizes, for example, to be able to land on a corresponding-sized seat or baffle inside the wellbore. As such, the mold can be a variety of sizes and shapes. The mold can also be used to produce a portion of the isolation device, wherein the final completed isolation device is produced using the molded portion of the device and other components. The mold can be a flexible mold. This aspect can be useful when utilizing isostatic pressing for compacting the particles located inside the mold. For a flexible mold, the size and shape of the mold can be selected such that the compacted particles have a desired size and shape.

The step of placing can further comprise placing other particles (e.g., a second, third, or so on particles) into the mold along with the particles of the fusible alloy matrix powder. Examples of other particles include, but are not limited to, density-reducing particles and strength-enhancing particles. The other particles are selected from the group consisting of sand, plastic granules, ceramic beads, fibers, rods, acicular elements, sheets, whiskers, woven materials, glass microspheres, hollow glass microspheres, quartz, metallic compounds, metals such as aluminum or magnesium, polymers such as polyphenylene sulfide, polylactic acid, or polyglycolic acid, and combinations thereof. Preferably, the other particles have the shape of a sphere, spheroid, acicular, fibers, rods, whiskers, or woven material. The other particles can have a tensile strength greater than the particles of the fusible alloy matrix. The other particles can also have a density that is less than the particles of the fusible alloy matrix. Of course other types of particles that can have an effect on the physical properties of the at least the portion of the wellbore isolation device can also be added to the mold.

According to an embodiment, the other particles are incapable of melting at the bottomhole temperature of the wellbore. Preferably, the other particles have a size distribution less than or equal to a sufficient size such that the other particles are capable of being flowed from the wellbore 11 after the fusible alloy matrix has melted or otherwise undergone a phase transformation in the wellbore. According to an embodiment, the other particles have a phase transformation temperature that is greater than the phase transformation temperature of the fusible alloy matrix. The other particles can also have a phase transformation temperature that is greater than the bottomhole temperature of the wellbore.

The methods can further include coating a plurality of the other particles with the fusible alloy matrix. The coated other particles can then be placed into the mold. The other particles can be coated via vacuum deposition, such as physical or chemical vapor deposition, among other techniques known to those of ordinary skill in the art.

The methods can further include the step of blending the particles (i.e., the fusible alloy matrix powder and any other optional particles) together before the step of placing into the mold. According to an embodiment, the other particles are uniformly distributed throughout the fusible alloy matrix. In this manner, any properties attributable to the other particle (e.g., an increase in compressive strength) is applied equally throughout. In another embodiment, a plurality of the optional particles are coated with the fusible alloy. Then, the optional particles and the fusible alloy are added simultaneously to the mold. In yet another embodiment, different layers are created with different concentrations and different constituents of both the optional particle and of the fusible alloy. For example, the outer layer may have more of the strengthening particles while the inner layer may have more of the density reducing particles.

The methods include compacting the particles located inside the mold via an application of pressure. The density and porosity of the final solid material can be achieved by selecting the appropriate pressure for compaction of the particles. Compacting pressures can range from about 80 pounds force per square inch (psi) (0.6 megapascals "MPa") to about 100,000 psi (690 MPa). One of ordinary skill in the art will be able to select the appropriate pressure for compacting the particles based on the desired final density and porosity. The compaction of the particles can be achieved via a compaction tool, such as, tools designed for single-action compaction, double-action compaction, or multi-action compaction. The tool can also include a floating die. The tool can be used for cold or hot pressing. The compaction can also be from isostatic pressing. In isostatic pressing, the particles are placed into a flexible mold and then a high-pressure fluid, such as a liquid or gas, is applied to the outside of the flexible mold. The mold contracts as the particles are compacted together. The isostatic pressing can be cold or hot isostatic pressing. For cold isostatic pressing, the compaction occurs below the sintering or melting temperature of the fusible alloy matrix powder. For example, the compaction can be performed at ambient or room temperature of approximately 71° F. (21.7° C.). The amount of pressure can be very limited, for example, depending on the desired amount of porosity in the fusible alloy matrix. By way of example, the amount of pressure can be only that amount involved with placing the particles into the mold and placing a covering or similar apparatus on the mold to contain the particles.

The methods also include fusing the particles together to form a solid material, wherein the solid material forms at least the portion of the wellbore isolation device. The solid material can also be the entire wellbore isolation device and not just a portion of the device. As discussed earlier, the solid material can further be machined to create the portion of or the entire wellbore isolation device. The particles can be fused together at room temperature. Depending on the materials used to make up the fusible alloy matrix, heat can be applied to the particles during the step of fusing. The step of fusing can occur simultaneously with the step of compacting. An example of this is hot isostatic pressing. The step of fusing can also be performed after the step of compacting. According to this embodiment, the methods can further include the step of removing the compacted particles from the mold prior to the step of fusing. The methods can also include placing the compacted particles, once removed from the mold, into a heat-generating apparatus, such as an oven prior to the step of fusing.

According to an embodiment, the amount of heat applied can be at least sufficient to raise the temperature of the fusible alloy to its sintering temperature. According to another embodiment, the amount of heat applied can be at least sufficient to raise the temperature of the fusible alloy to its melting temperature. The sintering temperature is lower than the melting temperature of the fusible alloy. In general, sintering can occur in three stages—during the first stage, neck growth proceeds rapidly but powder particles remain discrete; during the second stage, most densification occurs, the structure recrystallizes and the particles diffuse into each other; and during the third stage, isolated pores tend to become spheroidal and densification continues at a much lower rate. Moreover, sintering generally refers to the state the particles are in when they bond and that the majority of the particles were not turned molten or liquid to bond together to form the solid material—rather, the atoms in the powder particles diffuse across the boundaries of the particles, fusing the particles together and creating one solid piece of material. It should be understood that some melting of the matrix particles could occur during sintering. The fusible alloy matrix powder can also be heated to the alloy's melting temperature. According to this embodiment, the compacted particles should remain in the mold and the mold should not deform at this temperature such that the liquefied matrix and other particles remain enclosed within the mold until cooled to a solid. In another embodiment, the outer layer of the ball is melted while the core is not heated to a temperature above the transition temperature.

The step of fusing can further include reducing the temperature of the material after application of the heat. This embodiment may be useful when the particles are melted during the fusing process. In this manner, the melted particles can cool to the solid material. By way of example, after fusing together in a ball mold, the fusible alloy matrix and optionally any other particles can be cooled to a temperature sufficient for the material to be in a solid form. The ball can then be removed from the mold and used in the wellbore to provide zonal isolation. The cooling process can include a quenching step to create a different stress state in the outer section of the material than in the inner section.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of producing and using at least a portion of a wellbore isolation device comprising:

providing a fusible alloy matrix in a powdered form;

placing at least the particles of the fusible alloy matrix powder into a mold;

compacting the particles located inside the mold via an application of pressure;

fusing the particles together to form a solid material, wherein the solid material forms the at least a portion of the wellbore isolation device; and introducing the at least a portion of the wellbore isolation device into a wellbore; wherein the fusible alloy matrix undergoes a phase transformation at or near the bottomhole temperature of the wellbore after a desired amount of time.

2. The method according to claim 1, wherein the isolation device is a ball, a plug, a bridge plug, a wiper plug, or a packer.

3. The method according to claim 1, wherein the metal of the fusible metal alloy is selected from the group consisting of lead, tin, bismuth, indium, cadmium, silver, gallium, zinc, antimony, copper, and combinations thereof.

4. The method according to claim 1, wherein the step of placing further comprises placing other particles into the mold along with the particles of the fusible alloy matrix powder.

5. The method according to claim 4, wherein the other particles are density-reducing particles, strength-enhancing particles, or a combination thereof.

6. The method according to claim 4, wherein the other particles are selected from the group consisting of sand, plastic granules, ceramic beads, fibers, rods, acicular elements, sheets, whiskers, woven materials, glass microspheres, hollow glass microspheres, quartz, metallic compounds, metals, polymers and combinations thereof.

7. The method according to claim 4, wherein the other particles have a phase transformation temperature that is greater than the phase transformation temperature of the fusible alloy matrix.

8. The method according to claim 4, further comprising blending the particles together, wherein the step of blending is performed prior to the step of placing.

9. The method according to claim 4, further comprising coating a plurality of the other particles with the fusible alloy matrix.

10. The method according to claim 4, wherein the other particles are not uniformly distributed throughout the fusible alloy matrix.

11. The method according to claim 1, wherein the step of fusing is performed after the step of compacting.

12. The method according to claim 11, wherein the compaction is from cold isostatic pressing.

13. The method according to claim 1, wherein the step of fusing is performed simultaneously with the step of compacting.

14. The method according to claim 13, wherein the compaction is from hot isostatic pressing.

15. The method according to claim 1, further comprising removing the compacted particles from the mold prior to the step of fusing.

16. The method according to claim 1, wherein the fusible alloy is at its sintering temperature during the step of fusing.

17. The method according to claim 1, wherein the fusible alloy is at its melting temperature during the step of fusing.

18. The method according to claim 1, wherein the step of fusing further comprises applying heat to the particles.

19. A method of producing and using at least a portion of a wellbore isolation device comprising:

producing a fusible alloy matrix in a powdered form;

blending the particles of the fusible alloy matrix and at least one other type of particle together;

placing the particles into a mold;

compacting the particles located inside the mold via an application of pressure;

fusing the particles together to form a solid material, wherein the solid material forms the at least a portion of the wellbore isolation device; and introducing the at least a portion of the wellbore isolation device into a wellbore;

wherein the fusible alloy matrix undergoes a phase transformation at or near the bottomhole temperature of the wellbore after a desired amount of time.

20. A wellbore isolation device comprising:

a fusible alloy matrix, wherein the isolation device is formed by:

placing at least the particles of a fusible alloy matrix powder and other particles into a mold;

compacting the particles located inside the mold via an application of pressure; and fusing the particles together to form a solid material;

wherein the wellbore isolation device does not have stratification when placed in the wellbore.

21. The device according to claim 20, further comprising placing other particles into the mold along with the particles of the fusible alloy matrix powder.

22. The device according to claim 21, wherein the other particles are density-reducing particles, strength-enhancing particles, or a combination thereof.

23. The device according to claim 21, wherein the other particles are selected from the group consisting of sand, plastic granules, ceramic beads, fibers, rods, acicular elements, sheets, whiskers, woven materials, glass microspheres, hollow glass microspheres, quartz, metallic compounds, metals, polymers, and combinations thereof.

24. The device according to claim 21, further comprising coating a plurality of the other particles with the fusible alloy matrix.

25. The device according to claim 20, wherein the porosity of the solid material is less than 10%.

* * * * *